US008348462B2

(12) United States Patent
Vasta et al.

(10) Patent No.: US 8,348,462 B2
(45) Date of Patent: Jan. 8, 2013

(54) LIGHTING SYSTEM AND ASSEMBLING METHOD OF THE SAME

(75) Inventors: Giuseppe Vasta, Novate Milanese (IT); Luca Meneghetti, Desio (IT)

(73) Assignee: Khatod Optoelectronic Srl, Cinisello Balsamo (MI) (IT)

( * ) Notice: Subject to any disclaimer, the term of this patent is extended or adjusted under 35 U.S.C. 154(b) by 0 days.

(21) Appl. No.: 12/984,870

(22) Filed: Jan. 5, 2011

(65) Prior Publication Data

US 2011/0170292 A1 Jul. 14, 2011

(30) Foreign Application Priority Data

Jan. 8, 2010 (IT) ..... MI2010A0008

(51) Int. Cl.
*F21V 33/00* (2006.01)

(52) U.S. Cl. ..... 362/249.02; 362/311.02; 362/242; 362/239

(58) Field of Classification Search ..... 362/249.02, 362/311.02, 242, 238, 239
See application file for complete search history.

(56) References Cited

U.S. PATENT DOCUMENTS 7,226,185 B2 * 6/2007 Dolgin et al. ..... 362/239
2008/0100773 A1 * 5/2008 Hwang et al. ..... 349/62
2008/0219000 A1 9/2008 Fan
2008/0273327 A1 * 11/2008 Wilcox et al. ..... 362/267
2009/0310356 A1 * 12/2009 Laporte ..... 362/239

FOREIGN PATENT DOCUMENTS

EP 1 988 576 A1 11/2008
WO 2009/111494 A1 9/2009

OTHER PUBLICATIONS

Italian Search Report, dated Aug. 24, 2010, from corresponding Italian application.

* cited by examiner

*Primary Examiner* — Laura Tso
(74) *Attorney, Agent, or Firm* — Young & Thompson

(57) ABSTRACT

Optic group for a lighting system including a plurality of solid state light sources, includes a plurality of optics each positionable in proximity of at least a correspondent solid state light source, a planar housing matrix of the plurality of optics for facilitating assembly of the lighting system. The assembling method includes sequentially: a) rotating at least a first asymmetric optic with respect to a third axis, parallel to a longitudinal axis of at least a correspondent solid state light source, at a first predetermined angle measured with respect to an axis orthogonal to the third axis, so as to lead the first asymmetric optic in a first configuration which is rotated with respect to the third axis and centered over the correspondent housing; b) coupling the first asymmetric optic to a correspondent housing of the planar housing matrix, and maintaining the same in the first rotated configuration.

9 Claims, 5 Drawing Sheets

LIGHTING SYSTEM AND ASSEMBLING METHOD OF THE SAME

FIELD OF INVENTION

The present invention refers to a lighting system and to an assembling method of the same.

In particular the present invention refers to a lighting system provided of solid state lighting sources, in particular of the type LED or OLED, usable for street light and/or for lighting wide covered surfaces.

BACKGROUND OF THE INVENTION

The present street lighting systems show the problem of the luminous pollution, and besides determine high electric consumptions.

The use of solid state lighting systems permits to reduce the energetic consumptions.

The street lighting systems shows high production costs and designing costs in order to obtain a luminous distribution that permit to optimize the lighting for each typology of road.

In particular the realization costs of the moulds affect strongly on the final production cost of each single lighting system.

Alternatively to use the same lighting system for different road typology determine the disadvantage to have problems of homogenous of the luminous distribution with portions of road not correctly illuminated and therefore potentially dangerous, and besides in some cases the disadvantage to determine problems of luminous pollution, hence the illumination towards the sky.

Besides in case of a modification of the road, for example with the creation of a bicycle path, often it is necessary to substitute the entire illuminating body of the lighting system in order to have a correct illumination of the same.

SUMMARY OF THE INVENTION

The present invention refers to an optic group for a lighting system, a lighting system and an assembling method of the same.

The optic group includes a plurality of solid state light sources and comprises a plurality of optics each of which is positionable in proximity of at least a correspondent solid state light source, the optic group comprises also a planar housing matrix for the plurality of optics in order to facilitate the assembling of the lighting system same.

Said optic group comprises at least a planar supporting plate preferably polymeric in which is integrated in just one piece said planar housing matrix 50 of said plurality of optics 30.

Purpose of the present invention is to realize a lighting system and an assembling method of the same that permit to reduce the production and assembling costs of the lighting system.

Another purpose it to realize a lighting system and an assembling method of the same that permit to have an excellent homogenization of the light and at the same time that permit to reduce at a minimum the luminous pollution in case of use for street lighting.

Another purpose it to realize a lighting system and an assembling method of the same that permit to easily modify and in a various way the luminous distribution maintaining at the same time an excellent homogenization of the light and a reduced luminous pollution towards the sky.

Still another purpose it to realize a lighting system and an assembling method of the same that permit to easily modify the luminous distribution in case of a modification of the road typology, avoiding the substitution of the entire illuminating body.

Further purpose is that to have an optic group, a lighting system and an assembling method of the same that permit to reduce the number of components and the production costs of the same.

This goals are reached realizing a lighting system and an assembling method of the same according to claims 1 and 12.

Further features of the invention are pointed out in the following claims.

BRIEF DESCRIPTION OF THE DRAWINGS

The features and the advantages of a lighting system and an assembling method of the same according to the present invention will be more evident from the following description, exemplificative and non limitative, referred to the annexed schematic drawings in which.

DETAILED DESCRIPTION OF THE PREFERRED EMBODIMENTS

Figure 1:
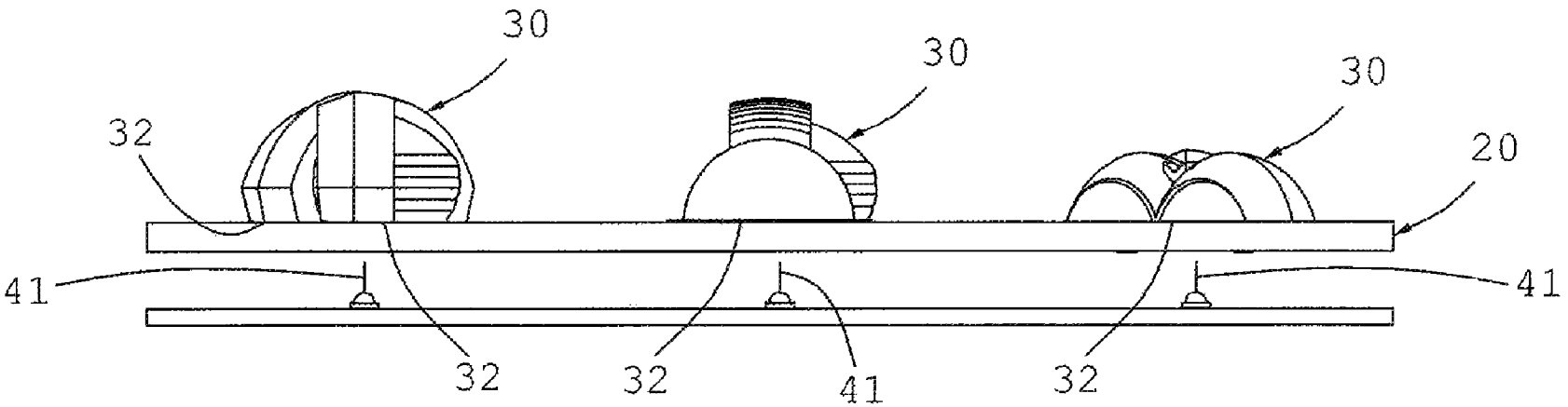
FIG. 1 is a raised lateral side view of a preferred form of embodiment of a lighting system according a preferred form of embodiment of the present invention.
Figure 2:
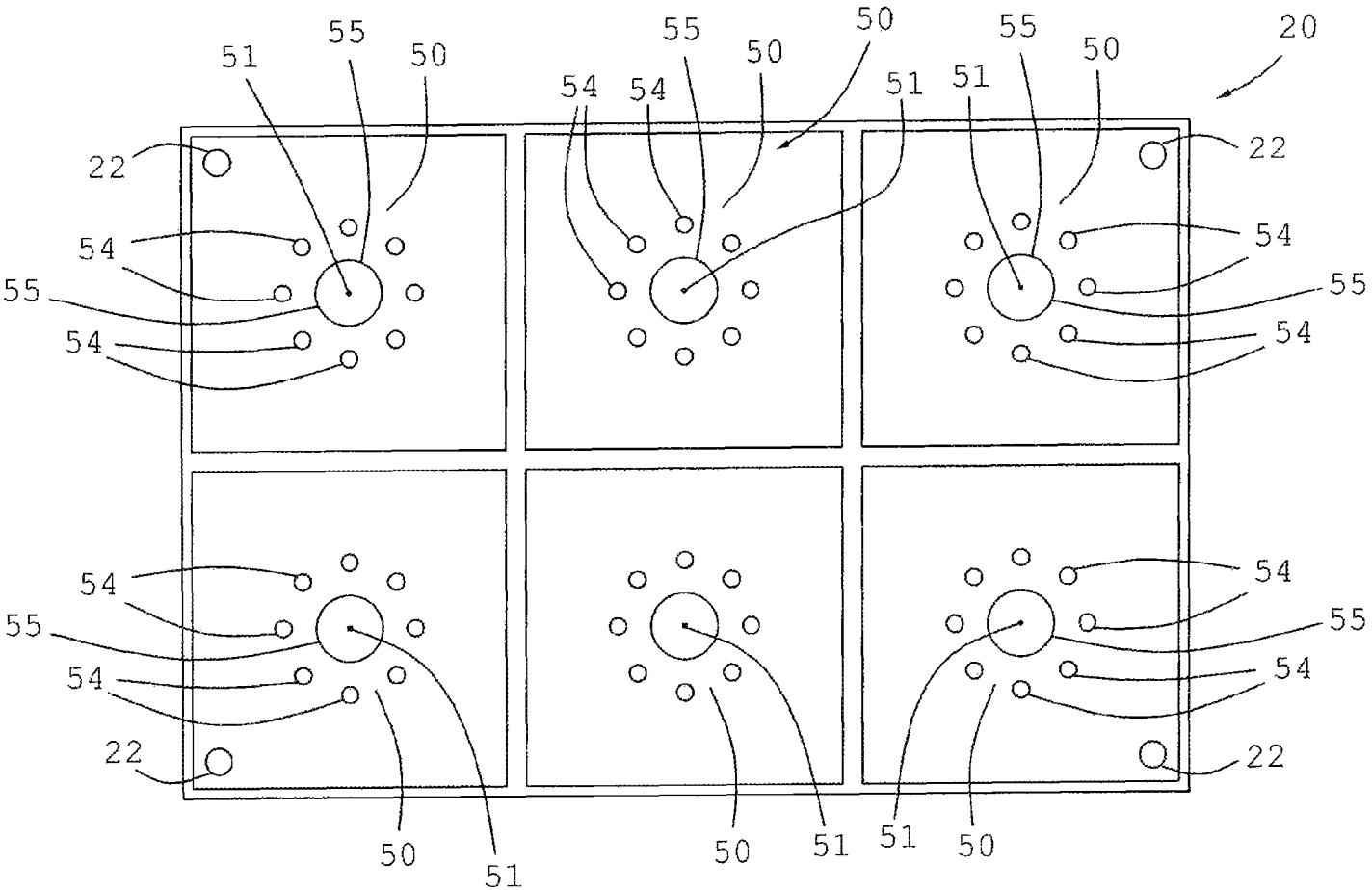
FIG. 2 is a top basal view of a supporting planar plate for a plurality of optics according to a preferred form of embodiment of the present invention.
Figure 3:
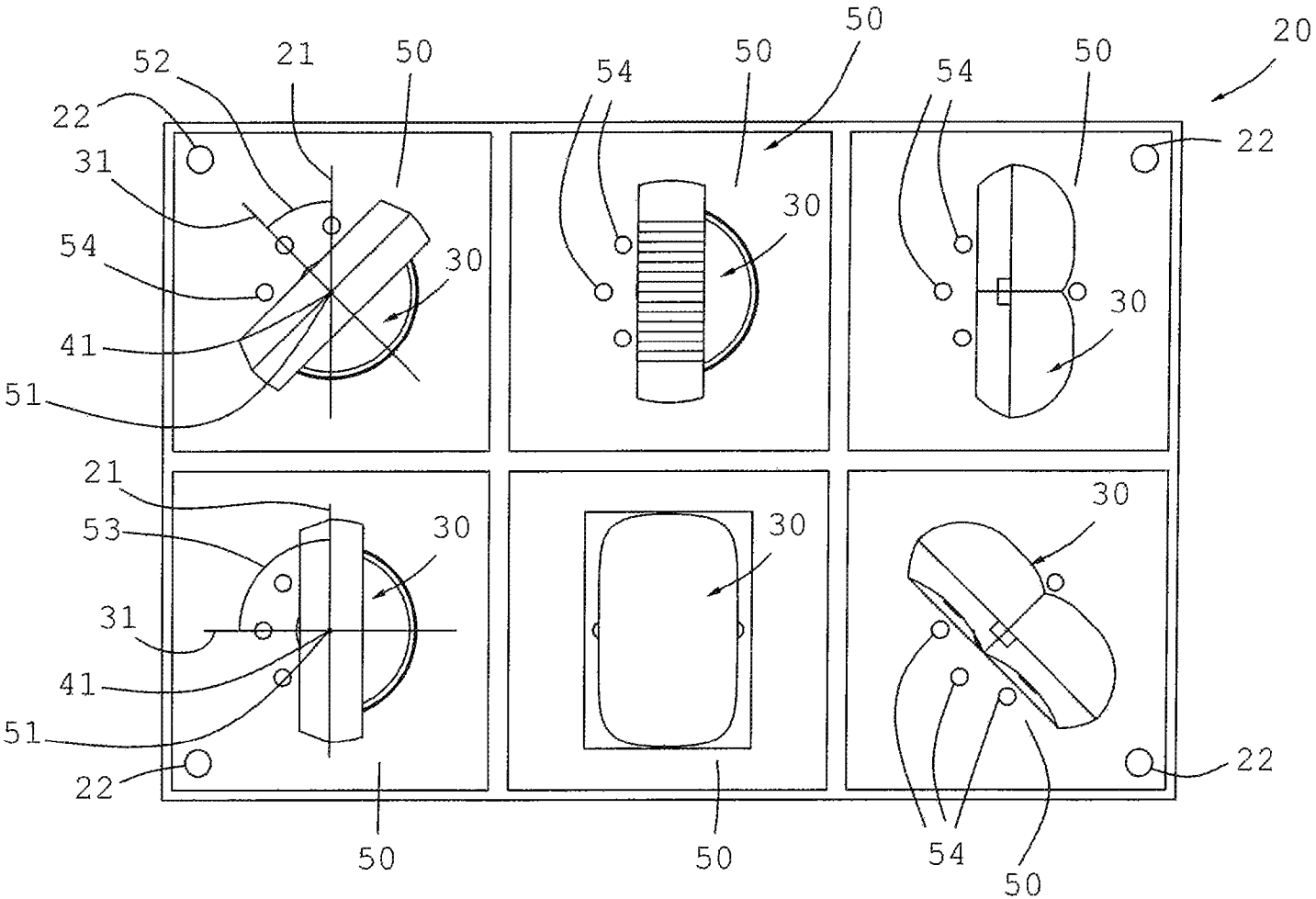
FIG. 3 is a top basal view of the supporting planar plate of FIG. 2 on which are mounted a plurality of optics in various configurations rotated the ones respect to the others.
Figure 4:
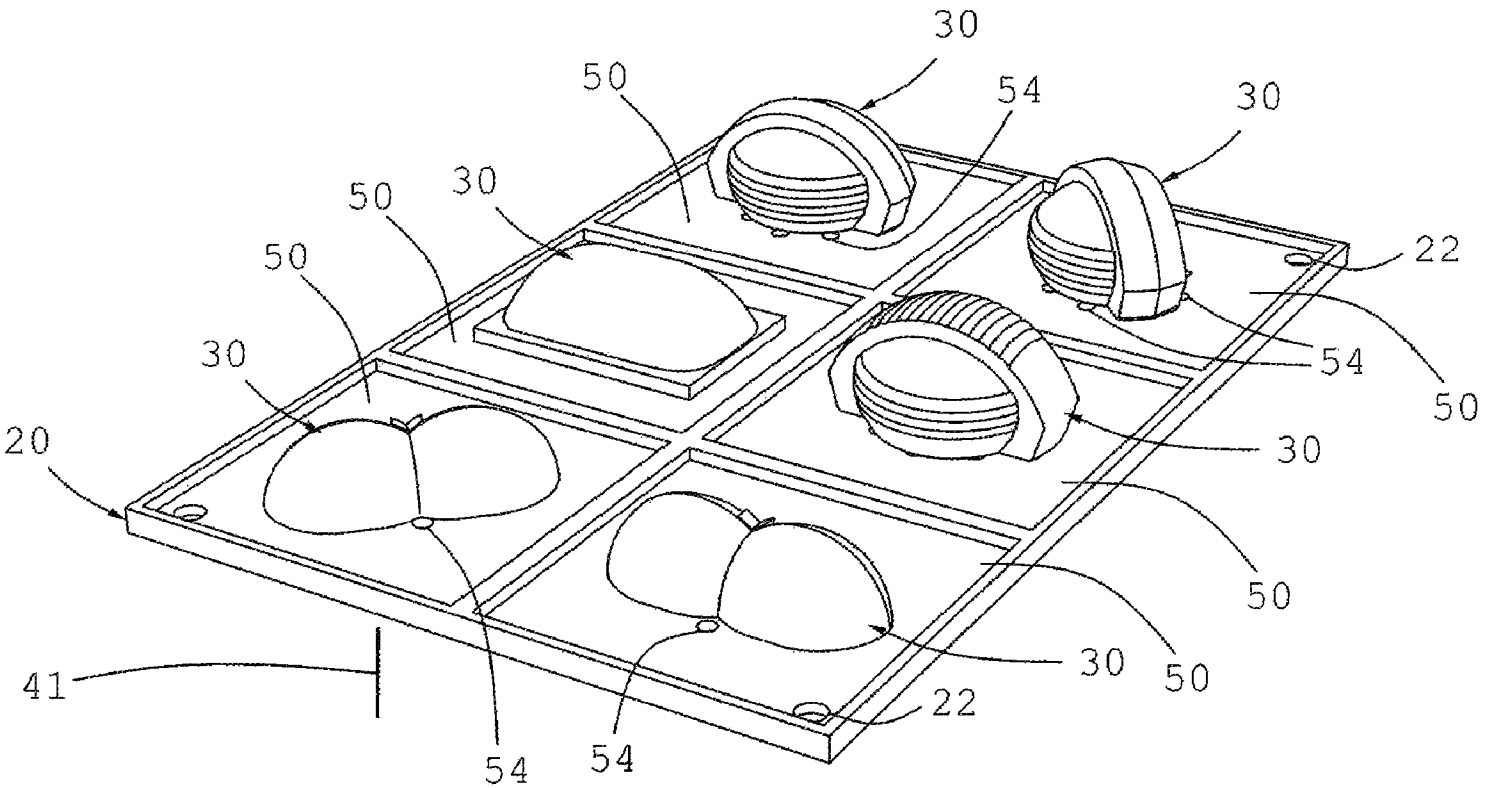
FIG. 4 is a perspective raised lateral side top view of the plate of FIG. 3 with the optics coupled to the same.
Figure 5:
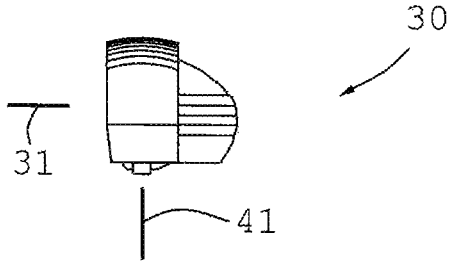
FIG. 5 is a raised lateral side view of a preferred form of embodiment of an optic of the lighting system of the present invention.
Figure 6:
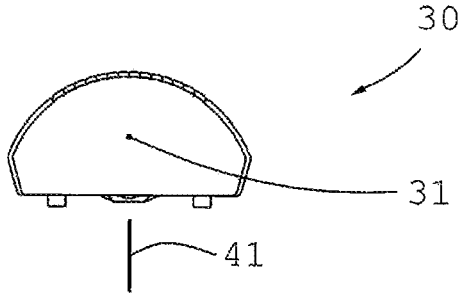
FIG. 6 is a raised frontal view of the optic of FIG. 5.
Figure 7:
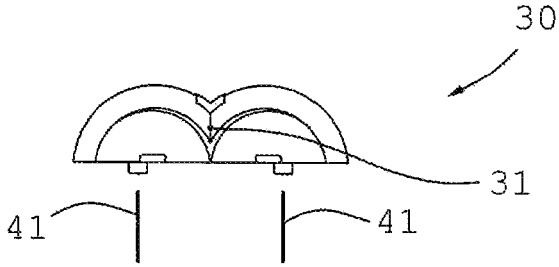
FIG. 7 is a raised frontal view from behind of a further preferred form of embodiment o fan optic of the lighting system of the present invention.
Figure 8:
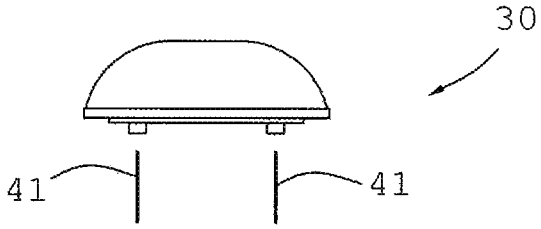
FIG. 8 is a raised frontal view of a further preferred form of embodiment of an optic of the lighting system of the present invention.

With reference to the figures, it is shown an optic group for a road lighting system of the type comprising a plurality of solid state light sources, in particular of the type LED or OLED (Organic Light Emitting Diode), said optic group comprising a plurality of optics 30 each of which is positionable in proximity of at least a correspondent solid state light source of said plurality of solid state light sources, in such a way to produce a light distribution for the desired application.

According to the present invention said optic group comprises a planar housing matrix 50 of said plurality of optics 30 in order to facilitate the assembling of the same lighting system in particular by means of surface assembly means preferably automatic or robotized.

Advantageously this permit to reduce the costs and production time since having a plurality of housings realized ordered in a way to form a planar housing matrix 50 make possible the use of surface assembly machines, avoiding to have to realize a manual assembly of the optics, since the use of automatic systems on non planar surfaces would determine extremely high costs and with various reliability problems of the same assembly.

Vice versa if the housings 50 were not positioned on the same plane at all and positioned in a way to form a planar matrix, in particular ordered, the assembly of the plurality of optics 50 on not planar surfaces would result extremely complicated and besides extremely expensive.

Through said housing planar matrix 50 besides, avoiding to direct the luminous flux towards the sky, said optic group permit to reduce at a minimum also the problem of the luminous pollution.

Preferably said planar housing matrix 50 is integrated in just one piece in at least a printed circuit board in which is mounted said plurality of solid state light sources.

Advantageously this permit to reduce at a minimum the production costs.

Alternatively in particular said optic group comprises at least a planar supporting plate 20 preferably polymeric in which is integrated in just one piece said planar housing matrix 50 of said plurality of optics 30.

Advantageously this permit to realize different luminous distributions and besides permit to quickly and simply modify a luminous distribution for example in case of modification of the road typology, for example after the realization of a bicycle path, simply substituting or modifying only the planar supporting plate 20 with a plurality of optics 30 fixed to the same, instead to substitute the entire illuminating body or the entire lighting system.

Preferably said at least a planar supporting plate 20 is a polymeric planar plate 20 with a polygonal base in particular with a substantially rectangular or square shape.

Advantageously this permit to further facilitate the assembly phase of the plurality of optic 30 on the planar supporting plate 20 of the plurality of optic 30.

Preferably said at least a planar supporting plate 30 comprises a plurality of centering bores 22 for the coupling with said at least a printed circuit board in order to simplify the assembly of the lighting system.

Besides preferably said at least a planar supporting plate 20 comprises male/female coupling means Each solid state light source produce a luminous flux symmetric respect to a longitudinal axis of the same, said longitudinal axis of each solid state light source is substantially orthogonal to said planar housing matrix 50, and in particular it is also substantially orthogonal to said at least a planar supporting plate 20.

Said plurality of optics 30 comprises at least an asymmetric optic 30 which is asymmetric respect to a longitudinal axis 41 of at least a correspondent solid state light source.

Preferably said at least an asymmetric optic 30 is symmetric respect to a symmetry axis 31 which is substantially orthogonal to a third axis, which is parallel to said longitudinal axis 41 of said at least a solid state light source and which pass through a central point 51 of the correspondent housing 50.

Preferably each symmetric optic 30 produce a luminous distribution inclined respect to said longitudinal axis 41 and in particular inclined respect to said third axis.

To have an asymmetric optic, which is mounted on said planar housing matrix 50, which besides redirect mainly a luminous flux in an direction inclined respect to a longitudinal axis 41 of at least a correspondent solid state light source, it permit to mix more luminous fluxes between them without have to incline the correspondent solid state light source or the same at least asymmetric optic 30.

Besides to use said at least an asymmetric optic with said planar housing matrix 50 permit at the same time to limit at a minimum the luminous pollution, to maximize the energetic efficiency, to reduce at a minimum the costs for moulds and also the total costs for said optic group and of said lighting system.

Advantageously this permit also to better direct the luminous fluxes for light better curved road paths, simply positioning at least an asymmetric optic 30 in a rotated position substantially coplanar with said planar housing matrix 50 in particular positioning the same in a rotated position respect to a third axis, which is parallel to said longitudinal axis 41 and in particular passing through a central point 51 of a correspondent housing 50, of a first predetermined angle 52, preferably included between 30° and 90°, which is measured respect to an axis 21 which is orthogonal to said third axis.

According to a preferred form of embodiment each correspondent optic 30 is a polymeric asymmetric lens 30, in particular respect to said longitudinal axis 41, which is able to produce at least an asymmetric luminous distribution respect to said longitudinal axis 41 and besides which determines an inclination of the luminous flux in an inclined direction respect to said longitudinal axis 41 of a correspondent solid state light source of an angle included between 35° and 55° and in particular included between 40° and 50°, in a way to avoid to incline said polymeric asymmetric lens same and/or said solid state light source 40.

In this way it is advantageously possible to easily and quickly assembly on a planar support, as said plurality of solid state light sources 40 as said plurality of asymmetric lenses 30.

In particular said at least an asymmetric optic 30 is at least an asymmetric lens 30 or at least a lens 30 coupled or integrated with correspondent light refracting means able to determine an asymmetric light flux inclined respect to said longitudinal axis 41 preferably of an angle included between 35° and 55°.

Preferably said at least an asymmetric lens 30 is able to produce a luminous distribution asymmetric along two directions orthogonal between them, each of the which is orthogonal to said longitudinal axis 41 of at least a correspondent solid state light source 40.

In particular said at least an asymmetric optic 30 produce a first luminous distribution asymmetric respect to a first axis which is orthogonal to a longitudinal axis 41 of a correspondent solid state light source and in particular which pass through a central point 51 of a correspondent housing 50, and besides produce a second luminous distribution asymmetric respect to a second axis orthogonal as to said longitudinal axis 41 as to said first axis.

Preferably said first asymmetric luminous distribution shows a luminous intensity peak which is inclined respect to said longitudinal axis 41 of a correspondent solid state light source of an angle included between 35° and 55° and in particular included between 40° and 50°, said first luminous distribution being asymmetric for distribute the light homogenously and uniformly along a portion of surface transversal to a direction along which are positioned a series of light points of said lighting system.

Preferably said second asymmetric luminous distribution shows a luminous intensity peak which is inclined respect to said longitudinal axis 41 of a correspondent solid state light source of an angle included between 35° and 55° and in particular included between 40° and 50°, said second luminous distribution being asymmetric for distribute the light homogenously and uniformly along a portion of surface wider along a path, also curved, along which are positioned a series of light points of said lighting system.

Preferably said at least an asymmetric optic 30 is at least an asymmetric lens 30 preferably polymeric which is realized in just one piece formed substantially by two half toroidal portions, in particular substantially orthogonal between them or aligned, which are compenetrated between them.

Preferably each half toroidal portion shows a symmetry axis, and besides said two half toroidal portions being compenetrated between them in a way that the correspondent symmetry axes of the same results substantially orthogonal or parallel between them, in particular each half toroidal portion is realized with an optic acrylic polymer.

Advantageously this permit to reduce the cost of said at least an asymmetric optic 30 and permit to have a luminous flux inclined respect to said longitudinal axis 41 of at least a correspondent solid state light source, without have to mount at least an optic 30 inclined respect to said housing planar matrix 50.

Preferably said plurality of optic 30 comprises at least two asymmetric optics 30 each of which produce a first luminous distribution asymmetric respect to a third axis parallel to said longitudinal axis 41 of a correspondent solid state light source and passing through a central point 51 of a correspondent housing 50.

With reference to the figures preferably at least an asymmetric optic 30 is coupled to a correspondent housing 50 and it is at the same time rotated respect to a third axis, which is parallel to said longitudinal axis 41 of a correspondent solid state light source and in particular which pass through a central point 51 of said correspondent housing 50, of a first predetermined angle 52, preferably included between 30° and 90°, which is measured respect to an axis 21 which is orthogonal to said third axis.

Analogously with reference to the figures preferably at least another asymmetric optic 30 is coupled to a correspondent housing 50 and at the same time it is rotated respect to a third axis, which is parallel to a longitudinal axis 41 of a correspondent solid state light source and in particular which pass through a central point 51 of said correspondent housing 50, of a second predetermined angle 53 measured respect to an axis 21 which is orthogonal to said third axis.

Advantageously this permit to light in an homogeneous and uniformly way all the portions of any road path also curved or any type of wide internal commercial area as the area of a fair stand.

Preferably each housing 50 comprises coupling means which permit to center, or preferably to self-center, a correspondent optic 30 in a plurality of rotated positions respect to a third axis which is parallel to a longitudinal axis 41 of at least a correspondent solid state light source, in particular said plurality of rotated positions is besides substantially coplanar with said planar housing matrix 50.

Advantageously this permit to realize a great number of different lighting systems with the same optic 30 preferably asymmetric and with at least a planar supporting plate 20 reducing at a minimum the costs for moulds, and besides at the same time it permit to obtain easily numerous different global luminous distributions for various road typology or internal environment typology to light with an assembling method of the optics 30 very simple.

Preferably each rotated position is radially spaced from the others respect to said third axis.

In particular in said plurality of rotated positions a symmetry axis 31 of said correspondent optic 30 results rotated respect to a third axis, which is parallel to said longitudinal axis 41 of said at least a solid state light source and which pass through a central point 51 of the correspondent housing 50, o fan predetermined angle 52 measured respect to an axis 21 orthogonal to said third axis.

In other terms said coupling means of each housing 50 permit a relative positioning of a symmetry axis 31 of a correspondent optic 30, which is preferably orthogonal to said third axis maintaining said optic 30 centered respect to said at least a correspondent solid state light source, avoiding to incline said optic 30 or said at least a correspondent solid state light source, hence maintaining a planar configuration that permit to reduce the assembly costs of the plurality of optics 30.

In other terms said correspondent optic 30 results connectable with said planar housing matrix 50 in a way to be always easy positionable on the same plane in a plurality of rotated position and centered on at least a correspondent solid state light source.

At least a part of said plurality of optics 30 being preferably asymmetric hence it is possible to direct and mix a plurality of correspondent luminous distributions in a series of inclined directions respect to said longitudinal axis 41 advantageously obtaining an uniform and homogeneous global luminous distribution.

In this way it is also possible to position easily the plurality of asymmetric optics 30 obtaining always the same global luminous distribution, maximizing the luminous efficiency and minimizing the global effect of luminous pollution towards the top, hence maximizing strongly the "cut-off".

At the same time using the same typology of asymmetric optic 30 it is possible to realize lighting devices and systems having different global luminous distributions, maximizing always the luminous efficiency and reducing at the minimum the number of components and in particular the cost of the single asymmetric optic 30 and consequently also the total cost of the lighting system.

Hence said lighting system through said coupling means permit to produce only few typology of the optics 30 reducing at the minimum the costs of the moulds necessary for their production.

Besides said optic group and the lighting system permit to realize in a simple and versatile way numerous different luminous distributions using only one or few typology of asymmetric optics 30, reducing strongly the cost of the moulds.

Preferably said coupling means of each housing 50 comprise a plurality of holes or grooves 54 which are uniformly equally distributed radially respect to a central point 51 of each housing 50.

Besides preferably said coupling means comprise a central bore 55 coaxial with a central point 51 of a correspondent housing 50.

Preferably said coupling means comprises a plurality of holes 54 which are uniformly equally distributed radially respect to said central point 51 of each housing 50.

Advantageously this permit an easy fixing of the same, in particular through adhesive assembly from the side opposite to the coupling side with said plurality of optics 30.

Preferably each optic 30 comprises a plurality of correspondent coupling portions, in particular of the type male/female, which are realized on a inferior portion 32 of the same and which are connectable with said coupling means of a correspondent housing 50.

Preferably said plurality of optics 30 is made integral with said housing planar matrix 50 and in particular said plurality of optics 30 is realized in just one piece with said housing planar matrix 50.

Preferably said plurality of optics is realized with an transparent polymer and in particular with an optic transparent polymer which preferably is chosen between a transparent acrylic polymer, as for example an acrylic optic polymer, a transparent polymethylmethacrylate, a transparent polycarbonate and/or their derivates and/or their similar.

Advantageously this permit to avoid a disassembling and beside permit to reduced production costs.

According to another aspect of the present invention it is furnished a lighting system, which for example at least a lamp in particular at least a streetlamp, comprising a plurality of solid state light sources, in particular of the type LED or OLED (Organic Light Emitting Diode), and besides comprising an optic group as previously described.

The lighting system and the streetlamp of the present invention can be used for roads lighting and/or for light wide internal areas, as sheds or fairs, since they permit to light uniformly and homogenously wide surfaces using a reduced number of solid state light sources.

For example said lighting system and the streetlamp permit to easily light a road with one or more carriageway and eventually also a bicycles path positioned laterally to the same road.

At the same way the lighting system permit to light wide covered surfaces as stand of fair or sheds.

According to another aspect of the present invention it is furnished an assembling method of an optic group for a street lighting system of the type comprising a plurality of solid state light sources, in particular of the type LED or OLED, said optic group comprising a plurality of asymmetric optics 30 and besides comprising a planar housing matrix 50 of said plurality of asymmetric optics 30, said assembling method comprises the sequent phases:

a) rotate at least a first asymmetric optic 30 of said plurality of asymmetric optics 30 respect to a third axis, which is parallel to a longitudinal axis 41 of at least a correspondent solid state light source and besides which pass through a central point 51 of at least a correspondent housing 50 of said planar housing matrix 50, of a first predetermined angle 52, in particular included between 30° and 90°, which is measured respect to an axis 21 orthogonal to said third axis, in such a way to lead said at least a first asymmetric optic 30 in a first configuration which is rotated respect to said third axis and centered over said correspondent housing 50;

b) couple said at least a first asymmetric optic 30 to a correspondent housing 50 of said planar housing matrix 50, maintaining the same in said first rotated configuration.

Advantageously this permit in a very simple way to incline a luminous flux in a particular direction inclined respect to said third axis in order to obtain an homogeneous illumination of a road path also curvilinear, using always the same asymmetric optic 30.

Each solid state light source produce a luminous flux symmetric respect to a longitudinal axis 41 of the same.

Preferably each asymmetric optic 30 is asymmetric respect to a longitudinal axis 41 of at least a correspondent solid state light source and in particular it produce a luminous distribution inclined respect to said longitudinal axis 41 and in particular inclined respect to said third axis.

Advantageously this permit to have a luminous distribution inclined respect to said longitudinal axis 41 avoiding to incline each asymmetric optic 30 respect to said at least a correspondent solid state light source or vice versa.

This make simple the assembling of each asymmetric optic 30 on a planar surface, for example through automatic machine for the surface assembling, reducing at the minimum the cost and the time for the production, and maximizing advantageously the productivity.

Besides advantageously it will increase also the quality of the optic group since the surface of the asymmetric optic 30 will not be soiled by the fingers of a person and will be positioned always correctly in the same way.

Preferably each asymmetric optic 30 is symmetric respect to a symmetry axis 31 which is substantially orthogonal to said third axis.

With reference to the figures, in particular said phase a) includes to rotate a symmetry axis 31 of said at least a first asymmetric optic 30, which is substantially orthogonal to said axis, of a first predetermined angle 52 measured respect to an axis 21 which is orthogonal to said third axis in a way to lead said at least a first asymmetric optic in said first rotated configuration.

Preferably said assembling method comprises the sequent phases:

c) rotate at least a second asymmetric optic 30 of said plurality of asymmetric optics 30 respect to a third axis, which is parallel to a longitudinal axis 41 of at least a correspondent solid state light source and besides which pass through a central point 51 of at least a correspondent housing 50 of said planar housing matrix 50, of a second predetermined angle 53 which is measured respect to an axis 21 orthogonal to said third axis, in such a way to lead said at least a second asymmetric optic 30 in a second rotated configuration which is rotated respect to said third axis and centered over said correspondent housing 50;

d) couple said at least a second asymmetric optic 30 to a correspondent housing 50 of said planar housing matrix 50, maintaining the same in said second rotated configuration.

Preferably said first predetermined angle 52 and said second predetermined angle 53 are different.

Advantageously in this way it is possible in a very simple way to light at least two different portion of a surface for example of a road and in particular curvilinear, reducing at the minimum the luminous pollution, maximizing the energetic efficiency, and avoiding of having to incline said at least a first asymmetric optic 30 and said at least a second asymmetric optic 30 respect to said at least a correspondent solid state light source.

Preferably said longitudinal axis 41 of each solid state light source is substantially orthogonal to said housing planar matrix 50, and in particular it is also substantially orthogonal to said at least a supporting planar plate 20.

In particular in said second rotated configuration besides a symmetry axis 31 of said at least a second asymmetric optic 30, which is substantially orthogonal to said third axis, it results rotated of said second predetermined angle 53 respect to said axis 21.

With reference to the figures, in particular said phase c) includes to rotate a symmetry axis 31 of said second asymmetric optic 30, which is substantially orthogonal to said third axis, of said second predetermined angle 53 which is measured respect to said axis 21 which is orthogonal to said third axis in such a way to lead said at least a second asymmetric optic 30 in said second rotated configuration.

Preferably said phase b) comprises a phase of f) make integral, in particular by means of an ultrasonic welding, said at least a first asymmetric optic 30, and preferably also said at least a second asymmetric optic 30, to a printed circuit board in which is mounted said plurality of solid state light sources, in particular said housing planar matrix 50 is integrated in just one piece with at least a printed circuit board.

Preferably said phase b) comprises a phase of g) make integral said at least a first asymmetric optic 30, in particular by means of an ultrasonic welding, to a planar supporting plate 20 of said plurality of asymmetric optics 30, said planar supporting plate 20 is preferably realized in a polymeric material for reduce at the minimum the weight of the lighting system, in particular said housing planar matrix 50 of said plurality of optics 30 is integrated in just one piece with at least a planar supporting plate 20.

Preferably also said phase d) comprises said phase f) performed with said at least a second asymmetric optic 30 instead of said at least a first asymmetric optic 30.

Alternatively preferably also said phase d) comprises said phase g) performer with said at least a second asymmetric optic 30 instead of said at least a first asymmetric optic 30.

In particular at least an asymmetric optic 30 of said plurality of asymmetric optics 30 is at least an asymmetric lens 30 preferably polymeric, which is realized in just one piece formed substantially by two half toroidal portions, in particular substantially orthogonal between them or aligned, which are compenetrated between them.

Advantageously this permit to reduce the cost of said at least an asymmetric optic.

Preferably each half toroidal portion shows a symmetry axis, and besides said two half toroidal portions being compenetrated between them in such a way that the correspondent symmetry axes of the same result substantially orthogonal or parallel between them, in particular each toroidal portion is realized with an acrylic polymer.

Advantageously this permit to reduce the cost of said at least an asymmetric optic and permit to have a luminous flux inclined respect to a said longitudinal axis 41 of at least a correspondent solid state light source, without have to mount said at least an asymmetric optic 30 inclined respect to said planar housing matrix 50.

Preferably said assembling method comprises a phase of h) couple and fix each asymmetric optic 30 to a correspondent housing 50 of said housing planar matrix 50, which is preferably integrated in at least a supporting planar plate 20, in such a way that at least a first asymmetric optic 30 results rotated respect to a third axis parallel to a longitudinal axis 41 of a correspondent solid state light source, of said first predetermined angle 52, in particular include between 30° and 90°, and in such a way that at least a second asymmetric optic 30 result rotated respect to a third axis parallel to a longitudinal axis 41 of a correspondent solid state light source, of said second predetermined angle 53, in particular include between 30° and 90°, said first predetermined angle 52 and said second predetermined angle 53 being different between them and besides being measured respect to an axis 21 which is orthogonal to said third axis parallel to said longitudinal axis 41.

Advantageously this permit to realize easily very numerous lighting devices and systems in particular for street lighting and/or for light wide internal surfaces, modifying simply said first predetermined angle 52 or said second predetermined angle 53.

Besides it is preferably possible s) to fix the remaining asymmetric optics 30 in further rotated positions respect to said third axis, in a way to obtain a greatest series of solutions, which are interchangeable simply substituting for example said at least a supporting planar plate 20.

So it was seen that a lighting system and an assembling method of the same according to the present invention achieves the previously mentioned goals.

The so conceived lighting system and assembling method of the same can undergo to numerous modifications and variations, all included in the same inventive concept.

Furthermore, in practice the materials used, as well as their dimensions and the components, can vary according to the technical needs.

The invention claimed is:

1. Optic group for a road lighting system, comprising:

plural solid state light sources;

plural optics (30), each said optic (30) positionable in proximity a corresponding one of said solid state light sources; and a planar housing matrix (50) comprised of said plural optics (30), said plurality of optics (30) comprising at least one asymmetric optic (30) which is asymmetric with respect to a longitudinal axis (41) of the corresponding one solid state light source, wherein said at least one asymmetric optic (30) produces i) a first luminous distribution asymmetric with respect to a first axis orthogonal to said longitudinal axis (41) of the corresponding one solid state light source, passing through a central point (51) of a correspondent housing (50) of said housing matrix (50), and ii) a second luminous distribution asymmetric with respect to a second axis orthogonal to said longitudinal axis (41).

2. Optic group according to claim 1, wherein said planar housing matrix (50) is integrated in a printed circuit board in which is mounted said plurality of solid state light sources.

3. Optic group according to claim 1, further comprising at least a planar plate (20), in which planar plate (20) is integrated said planar housing matrix (50).

4. Optic group according to claim 1, wherein each housing (50) comprises coupling means to center a correspondent optic (30) in a plurality of rotated positions respect to a third axis which is parallel to the longitudinal axis (41) of the corresponding one solid state light source.

5. Optic group according to claim 4, wherein said coupling means of each housing (50) comprises a plurality of grooves (54) which are uniformly distributed radially with respect to said central point (51) of each housing (50).

6. Optic group according to claim 4, wherein said coupling means comprises a plurality of holes (54) which are uniformly distributed radially with respect to said central point (51) of each housing (50).

7. Lighting system for road lighting comprising said optic group according to claim 1.

8. Optic group for a road lighting system, comprising:

plural solid state light sources;

plural optics (30), each said optic (30) positionable in proximity of a corresponding one of said solid state light sources;

a planar housing matrix (50) comprised of said plural optics (30), said plurality of optics (30) comprising at least an asymmetric optic (30) which is asymmetric with respect to a longitudinal axis (41) of the corresponding one solid state light source, wherein said at least an asymmetric optic (30) comprises an asymmetric lens (30) realized in just one piece and formed substantially by two half toroidal portions which are compenetrated between them.

9. An assembling method of an optic group for a street lighting system comprising a plurality of solid state light sources, said optic group comprising a plurality of asymmetric optics (30) and comprising a planar housing matrix (50)

comprised of said plurality of asymmetric optics (30), said assembling method comprising the sequential steps of:

a) rotating at least a first asymmetric optic (30) of said plurality of asymmetric optics (30) with respect to a first axis parallel to a longitudinal axis (41) of a corresponding solid state light source and which passes through a central point (51) of at corresponding housing (50) of said planar housing matrix (50), the rotation being of a first predetermined angle (52) measured with respect to another axis (21) orthogonal to said first axis, sufficient to lead said first asymmetric optic (30) to a first configuration rotated respect to said first axis and centered over said correspondent housing (50); and b) coupling said at least a first asymmetric optic (30) to the corresponding housing (50) of said planar housing matrix (50), maintaining the first asymmetric optic (30) in said first rotated configuration, wherein said at least a first asymmetric optic (30) comprises an asymmetric lens (30) which is realized in just one piece formed substantially by two half toroidal portions, which are compenetrated between them.

* * * * *